US011709450B1

(12) United States Patent
Kato

(10) Patent No.: US 11,709,450 B1
(45) Date of Patent: Jul. 25, 2023

(54) IMAGE FORMING DEVICE

(71) Applicant: TOSHIBA TEC KABUSHIKI KAISHA, Tokyo (JP)

(72) Inventor: Tomoyuki Kato, Tagata Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/854,016

(22) Filed: Jun. 30, 2022

(51) Int. Cl.
*G03G 15/00* (2006.01)

(52) U.S. Cl.
CPC ... *G03G 15/751* (2013.01); *G03G 2221/1663* (2013.01)

(58) Field of Classification Search
CPC ..... G03G 2221/1663–1666; G03G 15/55–553
See application file for complete search history.

(56) References Cited

U.S. PATENT DOCUMENTS 7,469,117 B2 * 12/2008 Takahata ..... G03G 15/553 399/227
7,593,654 B2 * 9/2009 Ramesh ..... G03G 15/0266 399/48
9,342,262 B2 * 5/2016 Murayama ..... G06F 3/1236
11,016,416 B2 * 5/2021 Ajima ..... G03G 15/0863
2014/0321865 A1 10/2014 Takehisa et al.
2018/0150013 A1 5/2018 Nii et al.

FOREIGN PATENT DOCUMENTS

JP 04-359146 12/1992
JP 2005178058 A * 7/2005
JP 2007-199642 8/2007
JP 2010-217532 9/2010
JP 2014-139614 7/2014

* cited by examiner

*Primary Examiner* — Leon W Rhodes, Jr.
(74) *Attorney, Agent, or Firm* — Amin, Turocy & Watson, LLP

(57) ABSTRACT

To provide an image forming device that can effectively predict a replacement timing of a photoconductor drum. A toner image is to be formed on the photoconductor drum. The charger is configured to charge the photoconductor drum. The potential sensor is configured to measure a charge potential of the photoconductor drum. The memory stores a manufacturing date of the photoconductor drum and a failure threshold value of the charge potential related to a failure of the photoconductor drum. The processor is configured to calculate an elapsed time from the manufacturing date based on the manufacturing date, update the failure threshold value based on the elapsed time, and predict a replacement timing of the photoconductor drum based on the updated failure threshold value.

20 Claims, 7 Drawing Sheets

FIG. 3

| VALUE OBTAINED BY DRIVE TIME COUNTER | | 0 | | 200 | | 508 | | 1000 | |
|---|---|---|---|---|---|---|---|---|---|
| TEMPERATURE [℃] | LASER POWER[μW] | Vo | Ver | Vo | Ver | Vo | Ver | Vo | Ver |
| 10 | 125 | 888 | 211 | 881 | 277 | 871 | 379 | 855 | 542 |
| | 139 | 888 | 196 | 881 | 257 | 871 | 351 | 855 | 502 |
| | 153 | 888 | 182 | 880 | 235 | 870 | 316 | 854 | 446 |
| 25 | 125 | 885 | 196 | 877 | 256 | 865 | 348 | 845 | 496 |
| | 139 | 885 | 176 | 877 | 231 | 865 | 315 | 844 | 449 |
| | 153 | 884 | 160 | 876 | 208 | 863 | 281 | 843 | 397 |
| 50 | 125 | 880 | 170 | 870 | 220 | 854 | 297 | 828 | 420 |
| | 139 | 880 | 143 | 870 | 187 | 853 | 253 | 827 | 359 |
| | 153 | 878 | 124 | 868 | 162 | 851 | 221 | 824 | 315 |

IMAGE FORMING DEVICE

FIELD

Embodiments described herein relate generally to an image forming device.

BACKGROUND

Some image forming devices form a toner image on a photoconductor drum, transfer the toner image to a transfer body, and further transfer the toner image to a medium such as a paper sheet. Such an image forming device charges the photoconductor drum, and forms an electrostatic latent image on the photoconductor drum by using a laser or the like.

The photoconductor drum may not be sufficiently charged due to deterioration. When the photoconductor drum is not sufficiently charged, an operator such as a service person replaces the photoconductor drum. If the image forming device can predict a replacement timing of the photoconductor drum, the operator can smoothly replace the photoconductor drum.

DESCRIPTION OF THE DRAWINGS

FIG. 3 is a diagram showing a configuration example of a photoconductor coefficient table;

DETAILED DESCRIPTION

Therefore, a technique for predicting a replacement timing of a photoconductor drum is desired.

In order to solve the above problem, an image forming device that can effectively predict a replacement timing of a photoconductor drum is provided.

In general, according to one embodiment, an image forming device includes a photoconductor drum, a charger, a potential sensor, a memory, and a processor. A toner image is to be formed on the photoconductor drum. The charger is configured to charge the photoconductor drum. The potential sensor is configured to measure a charge potential of the photoconductor drum. The memory stores a manufacturing date of the photoconductor drum and a failure threshold value of the charge potential related to a failure of the photoconductor drum. The processor is configured to calculate an elapsed time from the manufacturing date based on the manufacturing date, update the failure threshold value based on the elapsed time, and more accurately predict a replacement timing of the photoconductor drum based on the updated failure threshold value.

Information on the manufacturing date may be year and month, or year, month, and date, or elapsed year, and has a function of recording the elapsed year since the photoconductor was manufactured regardless of whether the photoconductor is used.

Hereinafter, an embodiment will be described with reference to the drawings.

The image forming device according to the embodiment forms an image on a medium such as a paper sheet by using a toner. The image forming device forms a toner image on a photoconductor drum and transfers the toner image to a transfer body such as a transfer belt. The image forming device transfers, to the medium such as a paper sheet, the toner image transferred to the transfer body. The image forming device fixes the toner to the medium by heating the medium to which the toner image is transferred.

In addition, the image forming device predicts the replacement timing of the photoconductor drum. The image forming device presents a predicted replacement timing. Alternatively, the replacement timing of the photoconductor drum is predicted by, for example, an external device on a network based on information related to deterioration of the image forming device, and the predicted replacement timing is presented.

Figure 1:
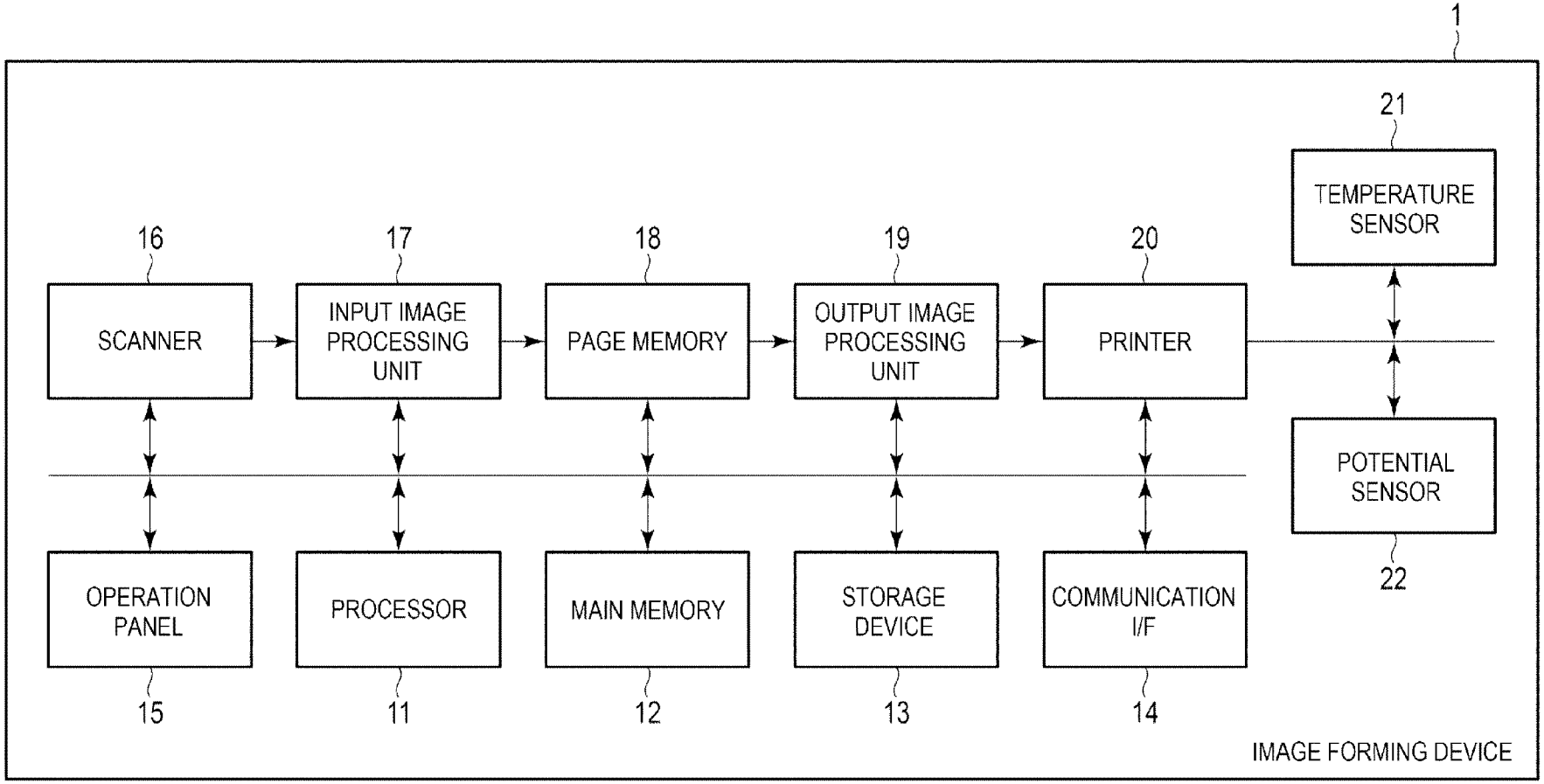
FIG. 1 is a block diagram showing a configuration example of an image forming device according to an embodiment.

FIG. 1 is a block diagram showing a configuration example of an image forming device 1 according to an embodiment.

As shown in FIG. 1, the image forming device 1 includes a processor 11, a main memory 12, a storage device 13, a communication interface 14, an operation panel 15, a scanner 16, an input image processing unit 17, a page memory 18, an output image processing unit 19, a printer 20, a temperature sensor 21, and a potential sensor 22. These units are connected to each other via a data bus or the like.

It should be noted that the image forming device 1 may have a component as required in addition to the components as shown in FIG. 1, or a specific component may be excluded from the image forming device 1.

The processor 11 has a function of controlling an operation of the entire image forming device 1. The processor 11 may include an internal memory and various interfaces. The processor 11 implements various processes by executing a program stored in advance in the internal memory or the storage device 13.

It should be noted that some of various functions implemented by the processor 11 executing the program may be implemented by a hardware circuit. In this case, the processor 11 controls the functions implemented by the hardware circuit.

The main memory 12 is a volatile memory. The main memory 12 is a working memory or a buffer memory. The main memory 12 stores various application programs based on a command from the processor 11. In addition, the main memory 12 may store data necessary for executing an application program and an execution result of an application program.

The storage device 13 is a non-volatile memory to which data can be written and in which data can be rewritten. The storage device 13 includes, for example, a hard disk drive (HDD), a solid state drive (SSD), or a flash memory. The storage device 13 stores a control program, an application, and various data according to an operational use of the image forming device 1.

The storage device 13 stores a drive time counter. The drive time counter counts a drive time of the photoconductor drum 30 (for example, a photoconductor drum 30K) described later. For example, the drive time counter counts a rotation time of the photoconductor drum 30 or the number of rotations of the photoconductor drum 30, and the number of sheets printed by the photoconductor drum 30.

When the photoconductor drum 30 is driven, the processor 11 causes the drive time counter to count up.

In addition, the storage device 13 stores a manufacturing date on which the photoconductor drum 30 is manufactured. For example, the storage device 13 stores or updates the manufacturing date at the time of manufacturing the photoconductor drum 30 or at the time of replacing the photoconductor drum 30. Information on the manufacturing date may be year and month, or year, month, and date, or elapsed year, and has a function of recording the elapsed year since the photoconductor was manufactured regardless of whether the photoconductor is used.

In addition, the storage device 13 stores a photoconductor coefficient table showing a relationship between a value obtained by the drive time counter and a charge potential of the photoconductor drum 30. The photoconductor coefficient table will be described later.

Various instructions are input to the operation panel 15 by an operator of the image forming device 1. The operation panel 15 transmits, to the processor 11, a signal indicating an instruction input by the operator. The operation panel 15 includes, for example, a keyboard, a numeric keypad, and a touch panel and the like as an operation unit.

In addition, the operation panel 15 displays various information for the operator of the image forming device 1. That is, the operation panel 15 displays, based on the signal from the processor 11, a screen showing various information. The operation panel 15 includes, for example, a monitor such as a liquid crystal display as a display unit. Further, the operation panel 15 may have a function including a function of an operation panel by, for example, an external device on a network, as a function of displaying information related to deterioration of an image forming device as a display unit.

The scanner 16 optically scans a document and reads an image of the document as image data. The scanner 16 reads the document as a color image. The scanner 16 is implemented by a sensor array or the like formed in a main scanning direction. The scanner 16 moves the sensor array in a sub-scanning direction and reads the entire document.

The input image processing unit 17 processes the image data read by the scanner 16. It should be noted that the input image processing unit 17 may process image data from other than the scanner 16. For example, the input image processing unit 17 may process image data received from a USB memory, a PC, a smartphone or the like.

The page memory 18 stores the image data processed by the input image processing unit 17.

The output image processing unit 19 processes the image data stored in the page memory 18 such that the printer 20 can print the image data on a paper sheet.

The printer 20 prints, on a paper sheet, the image data processed by the output image processing unit 19 under the control of the processor 11.

The printer 20 prints the image data on the paper sheet by, for example, an electrophotographic method. In addition, the printer 20 includes a transfer body, a roller that drives the transfer body, a photoconductor drum and the like. The printer 20 will be described later.

The temperature sensor 21 measures a temperature of the photoconductor drum 30. The temperature sensor 21 outputs, to the processor 11, a sensor signal indicating the temperature of the photoconductor drum 30. The temperature sensor 21 may include a thermistor and a thermal diode, or may include an infrared sensor.

The potential sensor 22 measures a potential (charge potential) charged on a surface of the photoconductor drum 30. Here, the potential sensor 22 measures a dark potential of the photoconductor drum. The potential sensor 22 outputs, to the processor 11, a sensor signal indicating the charge potential.

Next, the printer 20 will be described.

Figure 2:
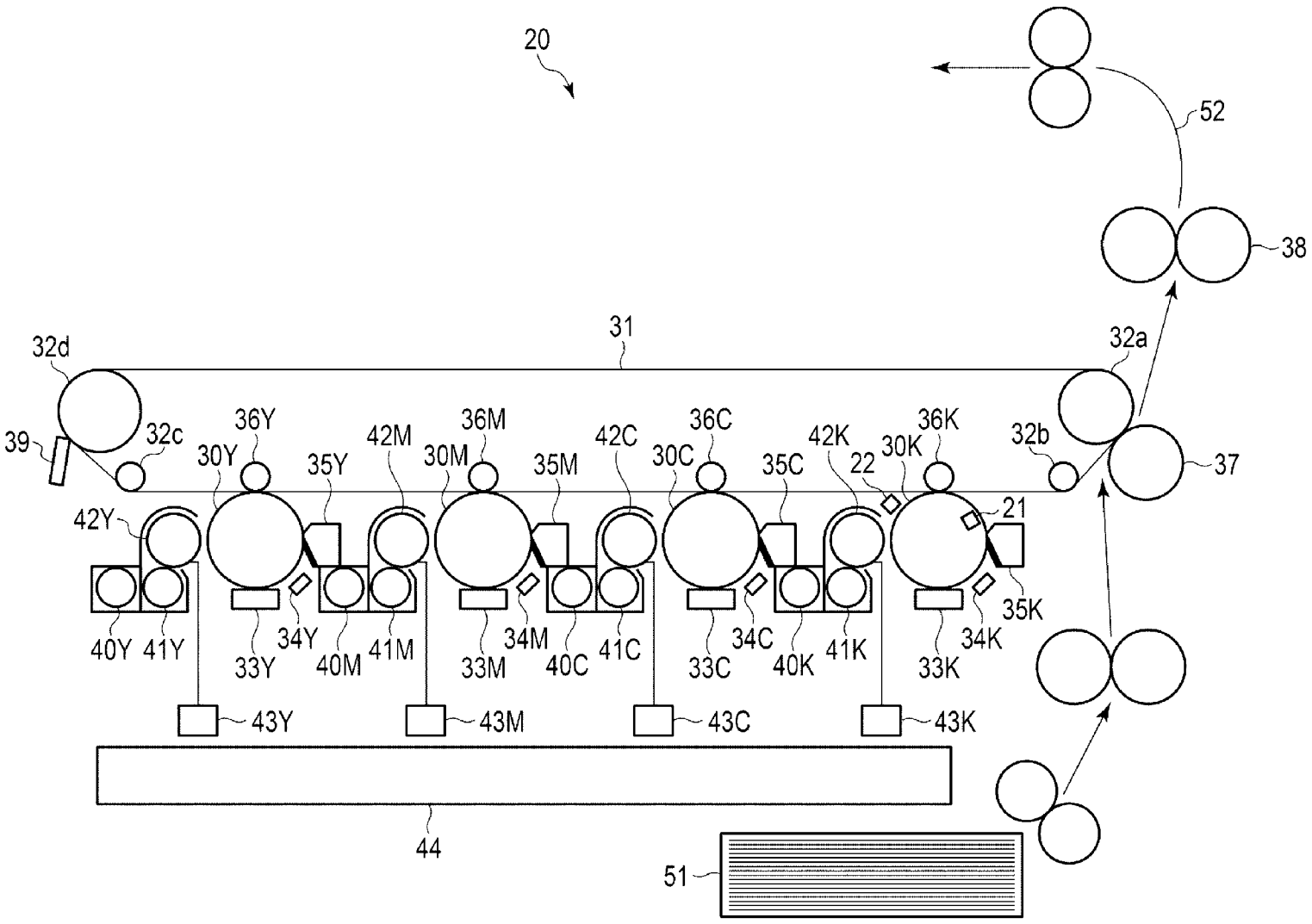
FIG. 2 is a diagram showing a configuration example of a printer.

FIG. 2 is a diagram showing a configuration example of the printer 20. As shown in FIG. 2, the printer 20 includes the photoconductor drum 30, a transfer body 31, a roller 32, a charger 33, a static eliminator 34, a photoconductor cleaner 35, a primary transfer roller 36, a secondary transfer roller 37, a fixing device 38, a transfer body cleaner 39, a developer 40, a stirrer 41, a developing roller 42, a voltage application unit 43, a paper sheet feed cassette 51, and a conveyance path 52.

The transfer body 31 is an intermediate transfer body. The transfer body 31 is formed in a belt shape. That is, the transfer body 31 is formed in a ring shape with a predetermined width.

The roller 32 is a roller that drives the transfer body 31. Rollers 32*a* to 32*d* are formed inside the transfer body 31. The rollers 32*a* to 32*d* pull the transfer body 31 from the inside with a predetermined tension to form a flat surface.

The rollers 32*a* to 32*d* are rotated by a drive force from a drive unit. The rollers 32*a* to 32*d* drive the transfer body 31 by rotating. It should be noted that some of the rollers 32*a* to 32*d* may be passively rotated.

The printer 20 includes the photoconductor drum 30, the charger 33, the static eliminator 34, the photoconductor cleaner 35, the primary transfer roller 36, the developer 40, the stirrer 41, the developing roller 42, and the voltage application unit 43 for every toner color. Here, the printer 20 includes the photoconductor drum 30, the charger 33, the static eliminator 34, the photoconductor cleaner 35, the primary transfer roller 36, the developer 40, the stirrer 41, the developing roller 42, the voltage application unit 43 and a laser unit for the corresponding toner of colors including cyan (C), magenta (M), yellow (Y) and black (K).

That is, the printer 20 includes photoconductor drums 30Y, 30M, 30C, and 30K as the photoconductor drum 30. In addition, the printer 20 includes chargers 33Y, 33M, 33C and 33K as the charger 33. In addition, the printer 20 includes static eliminators 34Y, 34M, 34C and 34K as the static eliminator 34. In addition, the printer 20 includes photoconductor cleaners 35Y, 35M, 35C and 35K as the photoconductor cleaner 35.

In addition, the printer 20 includes primary transfer rollers 36Y, 36M, 36C and 36K as the primary transfer roller 36. In addition, the printer 20 includes developers 40Y, 40M, 40C and 40K as the developer 40. In addition, the printer 20 includes stirrers 41Y, 41M, 41C and 41K as the stirrer 41. In addition, the printer 20 includes developing rollers 42Y, 42M, 42C and 42K as the developing roller 42. In addition, the printer 20 includes voltage application units 43Y, 43M, 43C and 43K as the voltage application unit 43.

Here, the photoconductor drum 30K, the charger 33K, the static eliminator 34K, the photoconductor cleaner 35K, the primary transfer roller 36K, the developer 40K, the stirrer 41K, the developing roller 42K, and the voltage application unit 43K will be described as a representative example.

The developer 40K is a container that contains a developer containing a toner and a magnetic carrier. The developer 40K receives a toner delivered from a toner cartridge.

The developer is contained in the developer 40K at the time of manufacturing or at the start of use.

The stirrer 41K is formed in the developer 40K. The stirrer 41K stirs the developer in the developer 40K. The stirrer 41K includes a screw that stirs the developer and a motor that rotates the screw.

In addition, the developing roller 42K is formed in the developer 40K. The developing roller 42K attracts the developer by a built-in magnet and rotates in the developer 40 to attach the developer to a surface of the developing roller 42K. The developing roller 42K is rotated by a motor. The developing roller 42K is one of rotation members for forming a toner image on the transfer body 31.

The voltage application unit 43K applies a development bias to the developing roller 42K under the control of the processor 11. For example, the voltage application unit 43K applies a development bias to the developing roller 42K. A toner of the developer attached to the developing roller 42K adheres to the photoconductor drum 30K due to an electric field generated by the development bias and a drum potential, and forms a toner image.

The charger 33K charges a surface of the photoconductor drum 30K to a constant potential. The charger 33K charges the photoconductor drum 30K by charging at a predetermined voltage (grid voltage) under the control of the processor 11.

The photoconductor drum 30K is a photoconductor including a cylindrical drum and a photosensitive layer formed on an outer peripheral surface of the drum. The photoconductor drum 30K is rotated at a constant speed by a power transmitted from the motor. The photoconductor drum 30K is one of the rotation members for forming a toner image on the transfer body 31.

The photoconductor drum 30K is charged by the charger 33K. The photoconductor drum 30K is irradiated with a laser from a laser unit 44 in a charged state while rotating. As a result, a bright electrostatic latent image is formed on the photoconductor drum 30K by the laser.

The primary transfer roller 36K is formed at a position facing the photoconductor drum 30K with the transfer body 31 interposed therebetween. The primary transfer roller 36K brings the transfer body 31 into contact with the photoconductor drum 30K. The primary transfer roller 36K transfers, to the transfer body 31, the toner image formed on the photoconductor drum 30K. The photoconductor drum 30K is one of the rotation members for forming a toner image. The primary transfer roller 36K is one of the rotation members for forming a toner image on the transfer body 31.

The photoconductor cleaner 35K includes a blade that is to come into contact with the surface of the photoconductor drum 30K. The photoconductor cleaner 35K removes a toner remaining on the surface of the photoconductor drum 30K by using the blade.

The static eliminator 34K removes a residual charge potential of the photoconductor drum 30K.

The paper sheet feed cassette 51 is a cassette that contains paper sheets as a medium. The paper sheet feed cassette 51 has a structure capable of supplying a paper sheet from outside of a housing of the image forming device 1. For example, the paper sheet feed cassette 51 has a structure that can be pulled out from the housing.

The conveyance path 52 conveys a paper sheet. For example, the conveyance path 52 picks up paper sheets one by one from the paper sheet feed cassette 51 and conveys the paper sheets. For example, the conveyance path 52 includes a roller and a conveyance belt.

The secondary transfer roller 37 transfers, to the paper sheet, the toner image formed on the transfer body 31. As shown in FIG. 2, the secondary transfer roller 37 is formed at a position facing the roller 32*a* with the transfer body 31 interposed therebetween. The secondary transfer roller 37 transfers the toner image on the transfer body 31 to the paper sheet conveyed by the conveyance path 52.

The fixing device 38 is formed downstream of the secondary transfer roller 37 in a paper sheet conveyance direction. The fixing device 38 fixes the toner image transferred to the paper sheet. The fixing device 38 fixes the toner image on the paper sheet by heating the toner image to a fixing temperature. For example, the fixing device 38 includes a heater.

The transfer body cleaner 39 includes a blade that is to come into contact with a surface of the transfer body 31. The transfer body cleaner 39 removes a toner remaining on the surface of the transfer body 31 by using the blade.

The laser unit 44 irradiates the photoconductor drums 30 with a laser under the control of the processor 11. The laser unit 44 forms an electrostatic latent image on the photoconductor drum 30 by irradiating the photoconductor drum 30 with a laser. For example, the laser unit 44 includes an emitting device that emits a laser and a polygon mirror that reflects the laser.

The printer 20 forms a toner image on the transfer body 31. The printer 20 transfers the toner image formed on the transfer body 31 to the paper sheet by using the secondary transfer roller 37. The printer 20 uses the fixing device 38 to heat the paper sheet on which the toner image is transferred to fix the toner image on the paper sheet. The printer 20 discharges the paper sheet on which the toner image is fixed to outside of the printer 20 through the conveyance path 52.

The temperature sensor 21 measures a temperature of the photoconductor drum 30K. The temperature sensor 21 may be provided on the photoconductor drum 30K or may be provided adjacent to the photoconductor drum 30K.

The potential sensor 22 measures a charge potential of the photoconductor drum 30K. The potential sensor 22 measures a charge potential of the photoconductor drum 30K charged by the charger 33K. The potential sensor 22 is provided downstream of the charger 33K. Here, the downstream means downstream in a direction in which the photoconductor drum 30K is driven.

Next, the photoconductor coefficient table will be described.

FIG. 3 shows a configuration example of the photoconductor coefficient table. Here, the photoconductor coefficient table shows the charge potential of the photoconductor drum 30 when the charger 33 charges the photoconductor drum 30 at a predetermined grid voltage (for example, −900 V).

As shown in FIG. 3, the photoconductor coefficient table shows a relationship between the value obtained by the drive time counter and the charge potential at every temperature of the photoconductor drum 30.

Here, the photoconductor coefficient table shows the relationship between the value obtained by the drive time counter and the charge potential at the corresponding temperature of 10° C., 25° C. and 50° C.

In addition, the photoconductor coefficient table shows a dark potential (Vo) and a bright potential (Ver) as a charge potential (V).

In addition, the photoconductor coefficient table shows a charge potential for every laser power emitted by the laser unit 44.

That is, the photoconductor coefficient table shows a dark potential (absolute value) and a bright potential (absolute value) at every temperature of the photoconductor drum 30, every value obtained by the drive time counter, and every laser power.

Next, the relationship between the charge potential and the value obtained by the drive time counter will be described.

Figure 4:
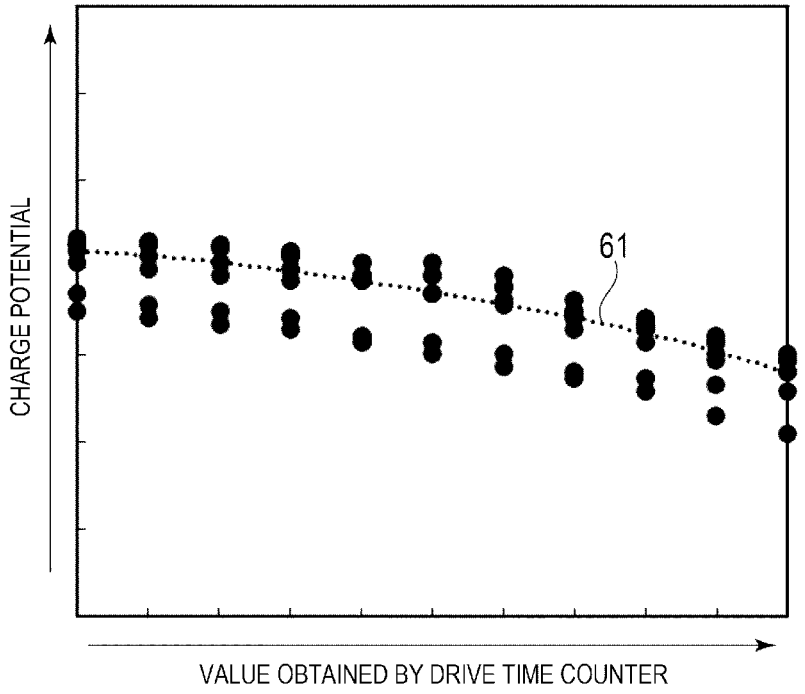
FIG. 4 is a graph showing a relationship between a drive time and a charge potential of a photoconductor drum.

FIG. 4 is a graph showing a relationship between an actually measured charge potential and the value obtained by the drive time counter. In FIG. 4, a horizontal axis represents the value obtained by the drive time counter. In addition, a vertical axis represents an absolute value of the charge potential. Here, the charge potential is a dark potential.

FIG. 4 shows a graph 61. The graph 61 is a regression curve showing the relationship between the charge potential and the value obtained by the drive time counter.

As shown in FIG. 4, when the value obtained by the drive time counter is small (that is, the drive time is short), the charge potential is large. As the value obtained by the drive time counter increases (that is, as the drive time increases), the charge potential decreases due to deterioration of the photoconductor drum 30.

Here, for example, a timing at which a consumption rate calculated based on a predetermined threshold value (failure threshold value, for example, 700 V) related to the charge potential is 100% is defined as a replacement timing of the photoconductor drum 30. The consumption rate will be described later.

It is assumed that the failure threshold value is calculated at any time and stored in the storage device 13 in advance.

Next, aging degradation of the photoconductor drum 30 will be described.

First, a relationship between an elapsed time and a potential step will be described.

Figure 5:
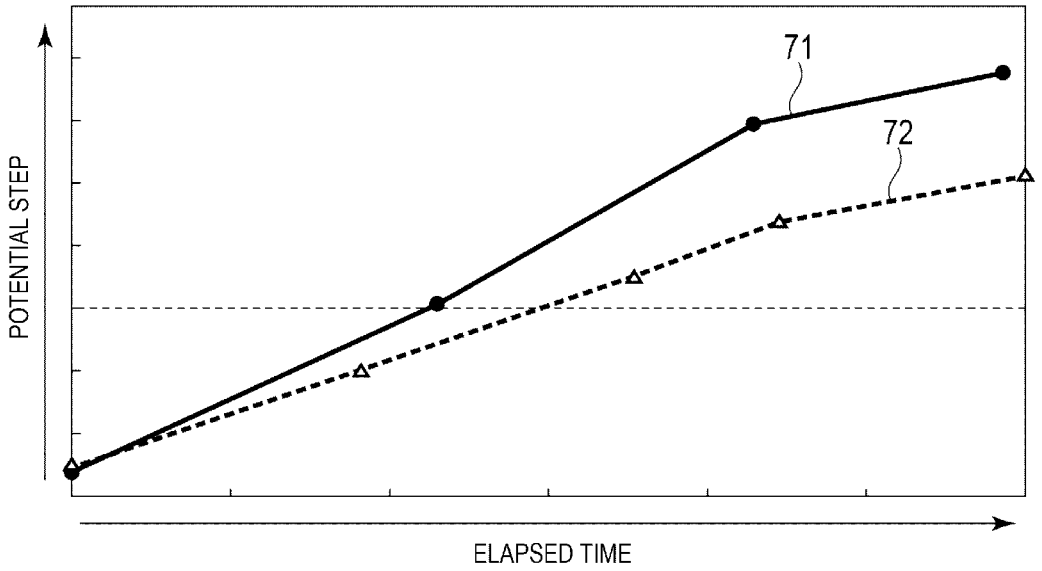
FIG. 5 is a graph showing a relationship between an elapsed time and a potential step.

FIG. 5 shows the relationship between the elapsed time and the potential step. In FIG. 5, a horizontal axis represents a time elapsed from the manufacturing date of the photoconductor drum 30 (elapsed time). A vertical axis represents the potential step.

The potential step is a step between a charge potential (dark potential) in a first rotation of the photoconductor drum 30 and a charge potential (dark potential) in a second rotation of the photoconductor drum 30. The photoconductor drum 30 may be rotated twice or more so as to form a transferred toner image to one sheet of paper. That is, a circumference of the photoconductor drum 30 may be shorter than a length of the toner image in the main scanning direction. Therefore, the photoconductor drum 30 is also charged in the second rotation immediately after being charged in the first rotation.

In this case, a difference (potential step) may occur between the charge potential in the first rotation and the charge potential in the second rotation. As the deterioration of the photoconductor drum 30 progresses, the potential step increases. Since a step in bright potential is generated due to the potential step in dark potential, unevenness occurs in image density on one sheet of paper, and a uniform image cannot be formed.

FIG. 5 shows a graph 71 and a graph 72.

The graph 71 shows a relationship between an elapsed time elapsed since the manufacturing date and the largest potential step among the variations in the potential step when the photoconductor drum 30 is not driven.

In addition, the graph 72 shows a relationship between the elapsed time elapsed from the manufacturing date and the smallest potential step among the variations in the potential step when the photoconductor drum 30 is not driven.

That is, the potential step generated due to the elapsed time falls between the graph 71 and the graph 72.

As shown in the graph 71 and the graph 72, as the elapsed time increases, the potential step increases.

Next, a relationship between the elapsed time and the charge potential will be described.

Figure 6:
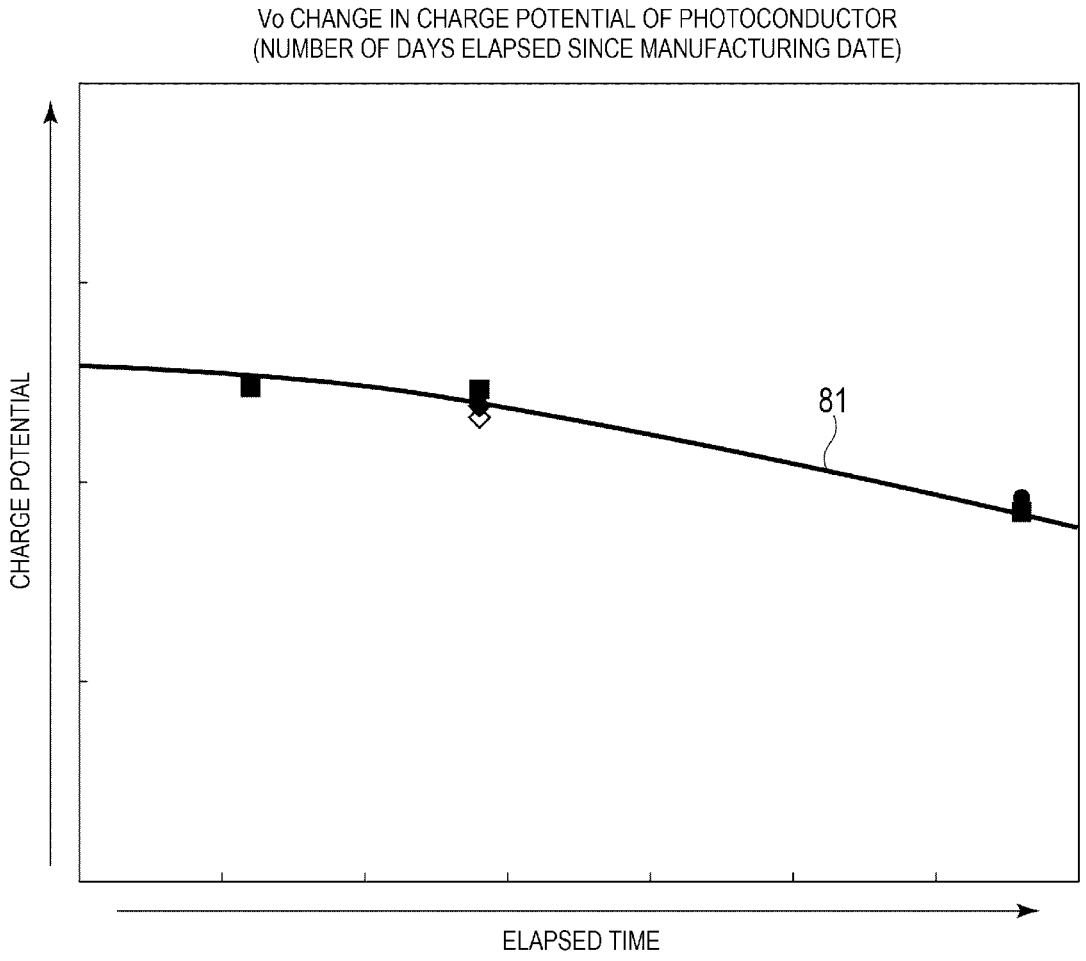
FIG. 6 is a graph showing a relationship between the elapsed time and the charge potential.

FIG. 6 shows the relationship between the elapsed time and the charge potential. In FIG. 6, a horizontal axis represents the elapsed time elapsed since the manufacturing date of the photoconductor drum 30. A vertical axis represents the absolute value of the charge potential of the photoconductor drum 30. Here, the charge potential is a dark potential.

FIG. 6 shows a graph 81.

The graph 81 shows the relationship between the elapsed time and the charge potential. The graph 81 shows a relationship between the charge potential and the elapsed time elapsed since the manufacturing date when the photoconductor drum 30 is not driven. That is, the graph 81 shows a change in charge potential due to aging degradation.

As shown in the graph 81, as the elapsed time increases, the charge potential decreases. That is, it can be said that as the elapsed time increases, the potential step between the first rotation and subsequent rotation of the photoconductor drum 30 described above increases, and the decrease in charge potential also increases.

The graph 81 is stored in the storage device 13 in advance. For example, the storage device 13 stores, as the graph 81, a table showing the relationship between the elapsed time and the charge potential. Further, the stored table can be changed, and for example, an appropriate table corresponding to a specification, a manufacturing method, and a leave condition of the photoconductor or the like can be stored.

Next, a function implemented by the image forming device 1 will be described. The function implemented by the image forming device 1 is implemented by the processor 11 executing a program stored in the storage device 13.

First, the processor 11 has a function of measuring the charge potential of the photoconductor drum 30.

The processor 11 rotates the photoconductor drum 30 in a state where a grid voltage is applied to the charger 33. The photoconductor drum 30 is in a state of being charged by the charger 33.

When the photoconductor drum 30 is charged, the processor 11 measures the charge potential of the photoconductor drum 30 by using the potential sensor 22. Here, the processor 11 measures a dark potential of the photoconductor drum 30K as the charge potential by using the potential sensor 22.

When the charge potential is measured, the processor 11 stores the measured charge potential in the storage device 13.

In addition, here, the processor 11 acquires a history of the charge potential from the storage device 13.

Alternatively, the processor 11 acquires a history of the charge potential recorded in an external storage device via a network.

In addition, the processor 11 has a function of updating the failure threshold value based on the elapsed time.

The processor 11 acquires the failure threshold value from the storage device 13. When the failure threshold value is acquired, the processor 11 calculates the elapsed time based on the manufacturing date of the photoconductor drum 30 and a current date.

When the elapsed time is calculated, the processor 11 acquires, from the graph 81 showing the relationship between the elapsed time and the charge potential, a charge potential on the manufacturing date and a charge potential after the calculated elapsed time. When the charge potential on the manufacturing date and the charge potential after the calculated elapsed time are acquired, the processor 11 calculates a difference (potential change amount) between the two charge potentials.

When the potential change amount is calculated, the processor 11 updates the failure threshold value based on the potential change amount. For example, the processor 11 updates the failure threshold value by adding the potential change amount to the failure threshold value.

In addition, the processor 11 has a function of further updating the failure threshold value based on the photoconductor coefficient table.

When the failure threshold value is updated based on the elapsed time, the processor 11 measures the temperature of the photoconductor drum 30 by using the temperature sensor 21. When the temperature is measured, the processor 11 acquires, from the photoconductor coefficient table, a dark potential corresponding to the measured temperature, a current value obtained by the drive time counter, and an output value of the laser power.

When the dark potential is acquired, the processor 11 calculates a difference (Vo difference) between the charge potential measured by using the potential sensor 22 and the dark potential acquired from the photoconductor coefficient table. When the Vo difference is calculated, the processor 11 further updates the updated failure threshold value based on the calculated Vo difference. For example, the processor 11 further updates the updated failure threshold value by adding (or subtracting) the Vo difference to (or from) the updated failure threshold value.

When the dark potential is acquired, the processor 11 acquires, from the photoconductor coefficient table, a dark potential derived from the temperature of the photoconductor drum 30 measured by using the temperature sensor 21 and a value obtained by the drive time counter at the time of the measurement, and calculates a difference (Vo difference) between the acquired dark potential and a dark potential assumed at a center temperature (here, 23° C.). When the Vo difference is calculated, the processor 11 further updates the updated failure threshold value based on the calculated Vo difference. For example, the processor 11 further updates the updated failure threshold value by adding (or subtracting) the Vo difference to (or from) the updated failure threshold value.

In addition, the processor 11 has a function of calculating the consumption rate based on the further updated failure threshold value.

When the updated failure threshold value is further updated, the processor 11 calculates the consumption rate based on the further updated failure threshold value.

The processor 11 calculates the consumption rate according to the following equation, for example.

$$\text{consumption rate} = \max\left\{\frac{1/\max[\text{charge potential}, 1] - 1/\text{initial potential}}{1/\text{failure threshold value} - 1/\text{initial potential}} \times 100.0\right\}$$

Here, the initial potential indicates a charge potential when the elapsed time is 0. That is, the initial potential is a charge potential corresponding to "0" as the elapsed time in the graph 81.

In addition, the processor 11 has a function of outputting a predicted consumption rate curve indicating a future consumption rate.

When the consumption rate is calculated, the processor 11 predicts the number of paper sheets to pass in future dates or a drive time based on a history of the number of passed paper sheets in the past or a history of a paper sheet passing time (driving time). For example, the processor 11 generates a curve for the predicted number of passed paper sheets, which shows a relationship between the elapsed time and the number of passed paper sheets.

Figure 7:
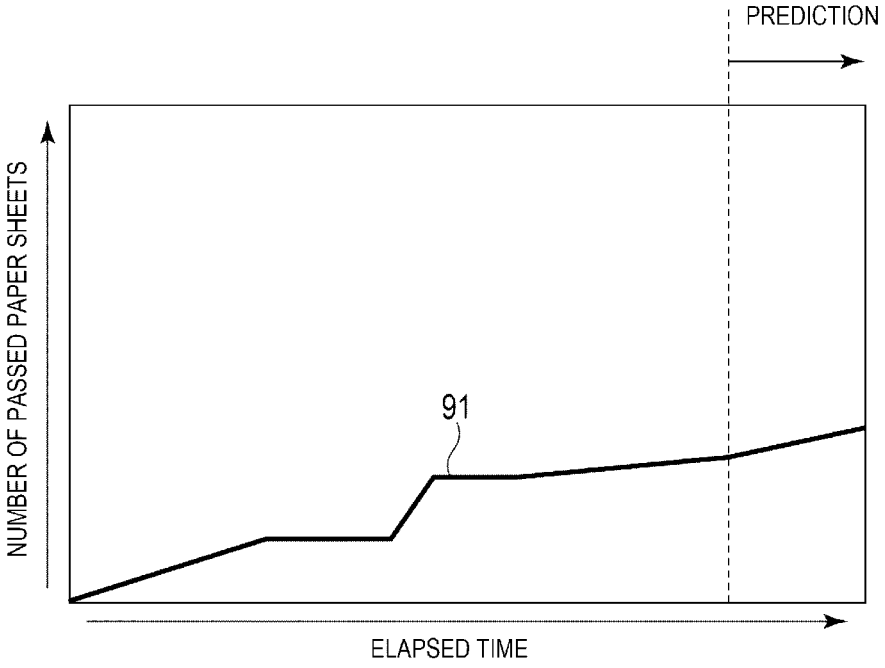
FIG. 7 is a graph showing a relationship between the elapsed time and the number of passed paper sheets.

FIG. 7 shows an example of the curve for the predicted number of passed paper sheets. In FIG. 7, a horizontal axis represents the elapsed time (number of days). In addition, a vertical axis represents the number of passed paper sheets.

FIG. 7 shows a curve for predicted number of passed paper sheets 91. As shown in FIG. 7, the curve for predicted number of passed paper sheets 91 includes a curve showing the number of passed paper sheets in the past and a curve showing prediction for the number of passed paper sheets in the future.

For example, the processor 11 generates the curve for predicted number of passed paper sheets 91 based on the history of the number of passed paper sheets in the past according to a predetermined algorithm. A method of generating the curve for predicted number of passed paper sheets 91 or a predicted usage time (drive time) by the processor 11 is not limited to a specific method.

When the curve for predicted number of passed paper sheets 91 is generated, the processor 11 generates a predicted consumption rate curve showing a relationship between the elapsed time and the consumption rate based on the curve for predicted number of passed paper sheets 91.

Figure 8:
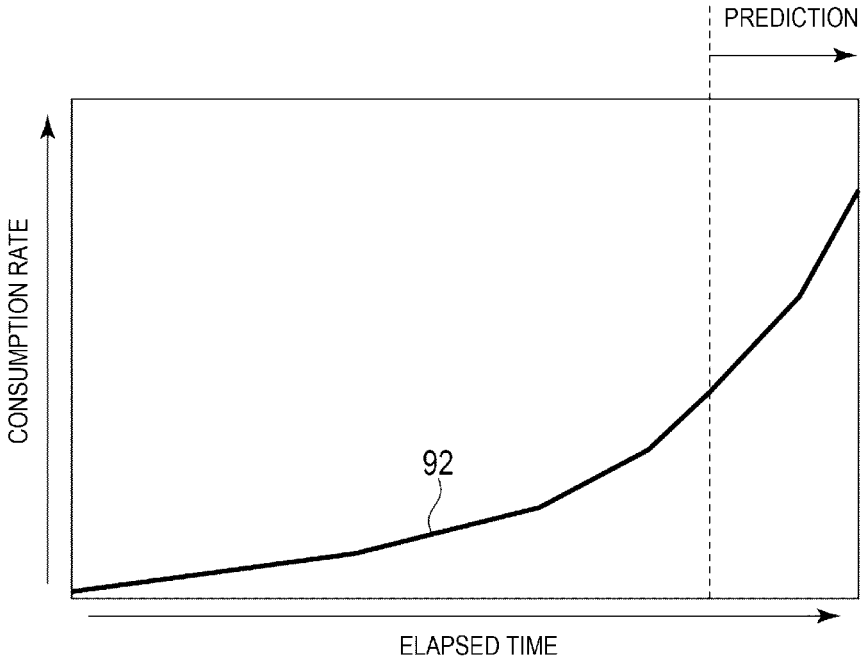
FIG. 8 is a graph showing a relationship between the elapsed time and a consumption rate.

FIG. 8 shows an example of the predicted consumption rate curve. In FIG. 8, a horizontal axis represents the elapsed time. In addition, a vertical axis represents the consumption rate.

FIG. 8 shows a predicted consumption rate curve 92. As shown in FIG. 8, the predicted consumption rate curve 92 includes a curve showing a consumption rate in the past and a curve showing prediction for a consumption rate in the future.

For example, the processor 11 predicts, based on the curve for predicted number of passed paper sheets 91, a relationship with the value obtained by the drive time counter in a future elapsed time. When the value obtained by the drive time counter in the future elapsed time is predicted, the processor 11 predicts a charge potential in the future elapsed time based on the predicted value obtained by the drive time counter and the photoconductor coefficient table.

When the charge potential in the future elapsed time is predicted, the processor 11 predicts a consumption rate in the future elapsed time based on the predicted charge potential and generates the predicted consumption rate curve 92.

When the predicted consumption rate curve 92 is generated, the processor 11 displays the generated predicted consumption rate curve 92 on the operation panel 15. In addition, the processor 11 may display the further updated failure threshold value on the operation panel 15. The processor 11 may transmit the further updated failure threshold value and electric detection potential information to the external device on the network.

In addition, the processor 11 may display, on the operation panel 15, the generated curve for predicted number of passed paper sheets 91. In this case, the operation panel 15 may have a function including a function of an operation panel by, for example, an external device on a network, as a function of displaying information related to deterioration of an image forming device as a display unit.

In addition, the processor 11 has a function of outputting an alert when the consumption rate is predicted to reach 100% within a predetermined period since a present time.

When the predicted consumption rate curve 92 is displayed, the processor 11 acquires, as the replacement timing of the photoconductor drum 30, a timing at which the consumption rate is predicted to reach 100%.

When the timing at which the consumption rate is predicted to reach 100% is acquired as the replacement timing of the photoconductor drum 30, the processor 11 determines whether the replacement timing of the photoconductor drum 30 is within the predetermined period (here, 15 days) since the present time.

When it is determined that the replacement timing of the photoconductor drum 30 is within the predetermined period since the present time, the processor 11 outputs an alert prompting replacement of the photoconductor drum 30. For example, the processor 11 displays the alert on the operation panel 15.

In addition, the processor 11 may transmit the alert to the external device via the communication interface 14, and may transmit the further updated failure threshold value and the electric detection potential information to the external device on the network. The operation panel 15 may have a function including a function of an operation panel by, for example, an external device on a network, as a function of displaying information related to deterioration of an image forming device as a display unit.

In addition, the alert may include the replacement timing of the photoconductor drum 30.

Next, an operation example of the image forming device 1 will be described.

Figure 9:
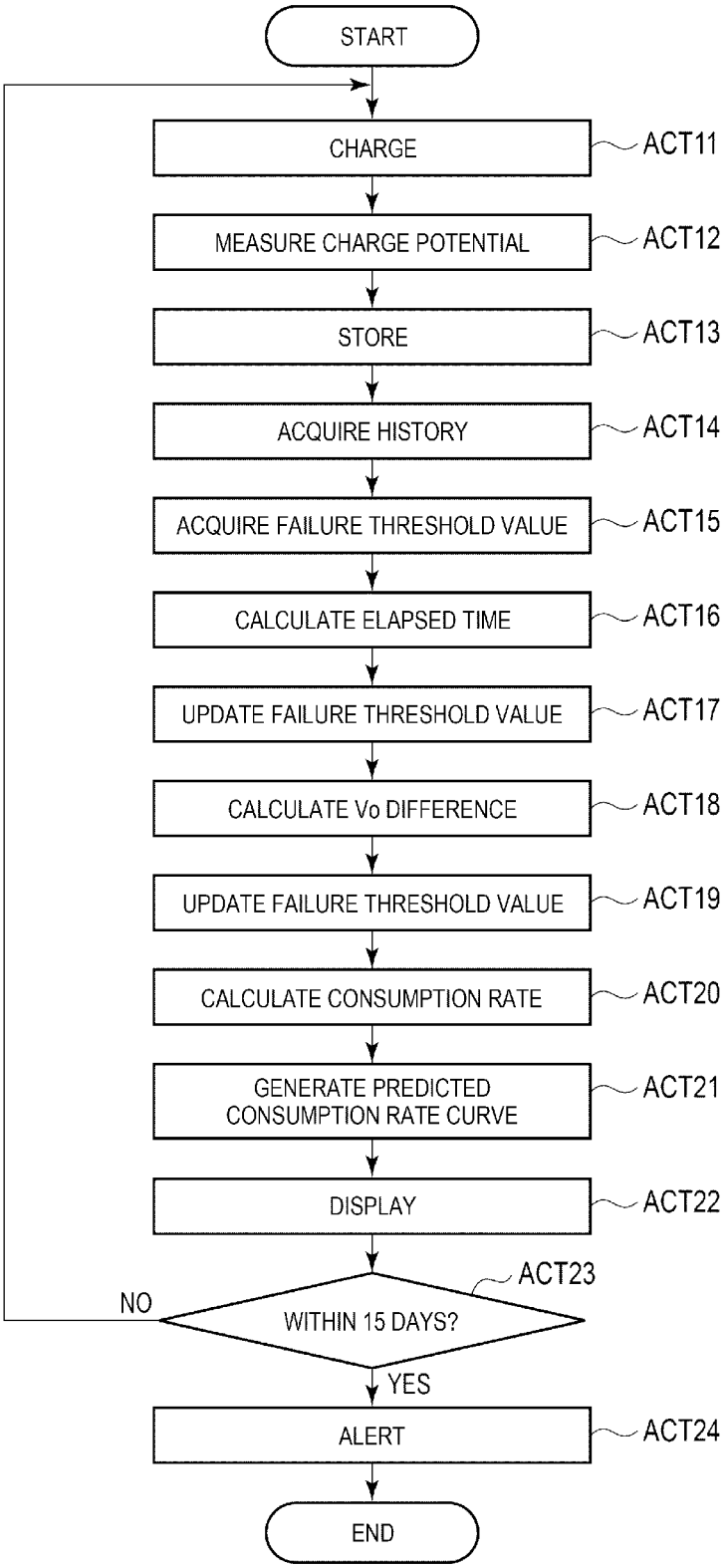
FIG. 9 is a flowchart showing an operation example of the image forming device.

FIG. 9 is a flowchart illustrating the operation example of the image forming device 1.

First, the processor 11 of the image forming device 1 charges the photoconductor drum 30 by using the charger 33 (ACT 11). When the photoconductor drum 30 is charged, the processor 11 measures a charge potential of the photoconductor drum 30 by using the potential sensor 22 (ACT 12).

When the charge potential of the photoconductor drum 30 is measured, the processor 11 stores the charge potential in the storage device 13 (ACT 13). When the charge potential is stored in the storage device 13, the processor 11 acquires a history of the charge potential from the storage device 13 (ACT 14).

When the history of the charge potential is acquired from the storage device 13, the processor 11 acquires a failure threshold value from the storage device 13 (ACT 15). When the failure threshold value is acquired from the storage device 13, the processor 11 calculates an elapsed time (ACT 16).

When the elapsed time is calculated, the processor 11 updates a failure threshold value based on the calculated elapsed time (ACT 17). When the failure threshold value is updated, the processor 11 calculates a Vo difference based on a dark potential in a photoconductor coefficient table and the measured charge potential (ACT 18).

When the Vo difference is calculated, the processor 11 further updates the failure threshold value based on the Vo difference (ACT 19). When the failure threshold value is further updated, the processor 11 calculates a consumption rate based on the further updated failure threshold value and the measured charge potential (ACT 20).

When the consumption rate is calculated, the processor 11 generates a predicted consumption rate curve based on the consumption rate and the like (ACT 21). When the predicted consumption rate curve is generated, the processor 11 displays the generated predicted consumption rate curve on the operation panel 15 (ACT 22).

When the generated predicted consumption rate curve is displayed on the operation panel 15, the processor 11 determines whether the replacement timing of the photoconductor drum 30 is within 15 days since a present time (ACT 23). When it is determined that the replacement timing of the photoconductor drum 30 is not within 15 days since the present time (NO in ACT 23), the processor 11 returns to ACT 11.

When it is determined that the replacement timing of the photoconductor drum 30 is within 15 days since the present time (YES in ACT 23), the processor 11 outputs an alert (ACT 24).

When the alert is output, the processor 11 ends the operation.

The processor 11 may execute ACT 11 to ACT 24 when a predetermined operation is input through the operation panel 15.

In addition, the processor 11 may execute the ACT 11 to ACT 24 at a predetermined interval.

In addition, the processor 11 may not update the failure threshold value based on the Vo difference.

In addition, the processor 11 may display the replacement timing of the photoconductor drum 30 on the operation panel 15.

The processor 11 may measure the corresponding charge potential and temperature of the photoconductor drums 30Y, 30M or 30C.

In addition, the processor 11 may not measure the temperature of the photoconductor drum 30. In this case, the processor 11 may update the failure threshold value by using a dark potential at the temperature of 25° C. in the photoconductor coefficient table.

Further, the processor 11 may be formed by an external device connected via the communication interface 14, and electric detection potential information and the updated failure threshold value may be transmitted to an external device on a network. The operation panel 15 may have a function including a function of an operation panel by, for example, an external device on a network, as a function of displaying information related to deterioration of an image forming device as a display unit.

The image forming device formed as described above updates a failure threshold value for predicting a replacement timing of a photoconductor drum based on an elapsed time since a manufacturing date of the photoconductor drum. The image forming device calculates a consumption rate based on the updated failure threshold value and a current charge potential. The image forming device predicts the replacement timing of the photoconductor drum based on the calculated consumption rate. As a result, the image forming device can predict the replacement timing of the photoconductor drum based on the deterioration due to driving of the photoconductor drum and aging degradation. Therefore, the image forming device can effectively predict the replacement timing of the photoconductor drum.

It should be noted that in the above-described embodiments, a case where a program executed by a processor is recorded in a memory of a device is described. However, the program executed by the processor may be downloaded from the network to the device or may be installed from a recording medium to the device. In addition, a function obtained by installation or download in advance may be implemented in cooperation with an OS (operating system) inside the device.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

While certain embodiments have been described, these embodiments have been presented by way of example only, and are not intended to limit the scope of invention. Indeed, the novel apparatus and methods described herein may be embodied in a variety of other forms; furthermore, various omissions, substitutions and changes in the form of the apparatus and methods described herein may be made without departing from the spirit of the inventions. The accompanying claims and their equivalents are intended to cover such forms or modifications as would fall within the scope and spirit of the inventions.

What is claimed is:

1. An image forming device, comprising:

a photoconductor drum on which a toner image is to be formed;

a charger configured to charge the photoconductor drum;

a potential sensor configured to measure a charge potential of the photoconductor drum;

a memory storing a manufacturing date of the photoconductor drum and a failure threshold value of the charge potential related to a failure of the photoconductor drum; and a processor configured to calculate an elapsed time from the manufacturing date to a present time, update the failure threshold value based on the elapsed time, and predict a replacement timing of the photoconductor drum based on the updated failure threshold value.

2. The image forming device according to claim 1, wherein the processor is configured to calculate, based on the elapsed time, a potential change amount between a charge potential on the manufacturing date and a charge potential when time is elapsed since the manufacturing date, and update the failure threshold value based on the potential change amount.

3. The image forming device according to claim 2, wherein the processor is configured to update the failure threshold value by adding the potential change amount to the failure threshold value.

4. The image forming device according to claim 1, wherein the processor is configured to calculate a consumption rate of the photoconductor drum based on the failure threshold value, and predict the replacement timing of the photoconductor drum based on the consumption rate.

5. The image forming device according to claim 4, wherein the processor is configured to generate, based on the consumption rate, a predicted consumption rate curve showing a relationship between the consumption rate and the elapsed time, and predict the replacement timing of the photoconductor drum based on the predicted consumption rate curve.

6. The image forming device according to claim 5, further comprising:

a monitor configured to display the predicted consumption rate curve.

7. The image forming device according to claim 1, wherein the memory is configured to store a table showing a drive time of the photoconductor drum and a charge potential at the drive time, and the processor is configured to acquire, from the table, the charge potential corresponding to a current drive time of the photoconductor drum, calculate a difference between the charge potential acquired from the table and the charge potential measured by the potential sensor, and further update the failure threshold value based on the calculated difference.

8. The image forming device according to claim 7, further comprising:

a temperature sensor configured to measure a temperature of the photoconductor drum, wherein the processor is configured to acquire, from the table, the charge potential corresponding to the current drive time and the temperature of the photoconductor drum.

9. The image forming device according to claim 1, wherein the processor is configured to output an alert when the replacement timing of the photoconductor drum is within a predetermined period relative to a present time.

10. The image forming device according to claim 1, wherein the potential sensor is configured to measure a dark potential as the charge potential.

11. A method of predicting photoconductor drum replacement, comprising:

storing a manufacturing date of a photoconductor drum and a failure threshold value of a charge potential related to a failure of the photoconductor drum;

charging the photoconductor drum;

measuring a charge potential of the photoconductor drum;

calculating an elapsed time from the manufacturing date to a present time;

updating the failure threshold value based on the elapsed time; and predicting a replacement timing of the photoconductor drum based on the updated failure threshold value.

12. The method according to claim 11, further comprising:

calculating, based on the elapsed time, a potential change amount between a charge potential on the manufacturing date and a charge potential when time is elapsed since the manufacturing date; and updating the failure threshold value based on the potential change amount.

13. The method according to claim 12, further comprising:

updating the failure threshold value by adding the potential change amount to the failure threshold value.

14. The method according to claim 11, further comprising:

calculating a consumption rate of the photoconductor drum based on the failure threshold value; and predicting the replacement timing of the photoconductor drum based on the consumption rate.

15. The method according to claim 14, further comprising:

generating, based on the consumption rate, a predicted consumption rate curve showing a relationship between the consumption rate and the elapsed time; and predicting the replacement timing of the photoconductor drum based on the predicted consumption rate curve.

16. The method according to claim 11, further comprising:

storing a table showing a drive time of the photoconductor drum and a charge potential at the drive time;

acquiring, from the table, the charge potential corresponding to a current drive time of the photoconductor drum;

calculating a difference between the charge potential acquired from the table and the charge potential measured by the potential sensor; and further updating the failure threshold value based on the calculated difference.

17. The method according to claim 16, further comprising:

measuring a temperature of the photoconductor drum;

acquiring, from the table, the charge potential corresponding to the current drive time and the temperature of the photoconductor drum.

18. The method according to claim 11, further comprising:

outputting an alert when the replacement timing of the photoconductor drum is within a predetermined period relative to a present time.

19. A photoconductor drum replacement predictor system, comprising:

a charger configured to charge a photoconductor drum;

a potential sensor configured to measure a charge potential of the photoconductor drum;

a memory storing a manufacturing date of the photoconductor drum and a failure threshold value of the charge potential related to a failure of the photoconductor drum; and a processor configured to calculate an elapsed time from the manufacturing date to a present time, update the failure threshold value based on the elapsed time, and predict a replacement timing of the photoconductor drum based on the updated failure threshold value.

20. The photoconductor drum replacement predictor system according to claim 19, wherein the processor is configured to calculate, based on the elapsed time, a potential change amount between a charge potential on the manufacturing date and a charge potential when time is elapsed since the manufacturing date, and update the failure threshold value based on the potential change amount.

* * * * *